US009915088B2

(12) United States Patent
Catalano

(10) Patent No.: US 9,915,088 B2
(45) Date of Patent: Mar. 13, 2018

(54) DOOR STOP ASSEMBLY WITH DECORATIVE MEMBER

(71) Applicant: Kyle Catalano, Hammond, LA (US)

(72) Inventor: Kyle Catalano, Hammond, LA (US)

( * ) Notice: Subject to any disclaimer, the term of this patent is extended or adjusted under 35 U.S.C. 154(b) by 0 days.

(21) Appl. No.: 15/230,826

(22) Filed: Aug. 8, 2016

(65) Prior Publication Data

US 2016/0340957 A1 Nov. 24, 2016

Related U.S. Application Data

(63) Continuation-in-part of application No. 14/304,878, filed on Jun. 13, 2014, now abandoned.

(51) Int. Cl.
*E05F 5/06* (2006.01)

(52) U.S. Cl.
CPC ..... *E05F 5/06* (2013.01); *Y10T 16/61* (2015.01)

(58) Field of Classification Search
CPC ..... E05C 17/12; E05C 17/46; E05C 17/52; E05C 17/56; E05C 17/203; Y10T 292/11; Y10T 16/61; Y10T 16/615; Y10T 16/625; Y10T 16/628; Y10T 16/6285; E05F 5/02; E05F 5/06; E05B 77/34
USPC ..... D8/402; D20/43; 40/331; 16/402
See application file for complete search history.

(56) References Cited

U.S. PATENT DOCUMENTS

| | | | | | |
|---|---|---|---|---|---|
| 383,809 | A * | 5/1888 | Herrick | E05F 5/06 | 16/86 A |
| 437,847 | A * | 10/1890 | Kieran | E05F 5/06 | 16/86 A |
| 841,147 | A * | 1/1907 | Hasenpflug | E05F 5/06 | 16/86 A |
| 918,060 | A * | 4/1909 | Kabureck | E05F 5/06 | 16/86 A |
| 1,869,793 | A * | 8/1932 | Bailey | A47C 7/002 | 16/42 T |
| 2,519,435 | A * | 8/1950 | Byrd, Jr. | E05C 19/16 | 16/82 |
| 2,760,224 | A * | 8/1956 | Hennelly | E05F 5/06 | 16/86 A |
| 3,244,443 | A * | 4/1966 | Rodgers | E05C 17/56 | 16/82 |
| 6,192,552 | B1 * | 2/2001 | Murphy | E05C 17/00 | 16/82 |
| 2006/0152019 | A1 * | 7/2006 | Depasquale | E05C 17/56 | 292/251.5 |
| 2007/0163077 | A1 * | 7/2007 | Yang | E05F 5/06 | 16/85 |

(Continued)

OTHER PUBLICATIONS

Doorstop 8022, Amazon.com, 2011, http://www.amazon.com/National-Hardware-BB8022-Doorstop-Chrome/dp/B002CTHJ5Q.

(Continued)

*Primary Examiner* — Jeffrey O'Brien
(74) *Attorney, Agent, or Firm* — Keaty Law Firm, LLC

(57) ABSTRACT

The invention relates to a doorstop having an interchangeable decorative member. The doorstop has an elongated post that is designed for securing behind an interior door of a building. The decorative member carries a fitting member on the back surface, which allows the decorative member to snap onto the post. Decorative indicia can be imprinted on the front surface of the decorative member.

11 Claims, 3 Drawing Sheets

(56) References Cited

U.S. PATENT DOCUMENTS

2012/0144624 A1* 6/2012 Swartz ..... E05F 5/06
16/82

OTHER PUBLICATIONS

Doorstop 8022 spec sheet, 2007, http://s7d1.scene7.com/is/content/StanleyNational/v8022-solid-doorstops_specification.
Doorstop 8022, http://www.natman.com/detail/8022-solid-doorstops-s825-984.

* cited by examiner

DOOR STOP ASSEMBLY WITH DECORATIVE MEMBER

CROSS-REFERENCE TO RELATED APPLICATIONS

This is a continuation-in-part application claiming priority from my co-pending application Ser. No. 14/304,878, filed in the United States Patent and Trademark Office on Jun. 13, 2014 for a "Door Stop Assembly with Decorative Member," which is hereby incorporated by reference.

BACKGROUND

The present invention relates generally to a door stop assembly, and more particularly to a door stop assembly that has a detachable decorative member.

Doorstops (or "door stops") are extensively used in modern structures to prevent a door from opening too widely and damaging nearby walls with door handles. In some cases, a rubber cylinder or dome is screwed into the wall or the baseboard in the path of the door. On occasion, stops are used that are fitted at the midpoint of the door, as part of the central door-hinge. Such a stop is known as a "hinge stop." The stops can be made in the form of a rod, a block of rubber-tipped metal, a spring, or so forth. Many door stops are provided with a rubber bumper tip that protects the door and the wall from damage.

When the door is open, a conventional door stop will be concealed by the door panel. When the door is closed, though, the door stop protrudes from the door hinge or from a baseboard. The aesthetics of a simple doorstop with a rubber tip are difficult to fit into a stylish interior. There is therefore a need in the art for a door stop assembly that prevents a door (and especially a door handle) or the like from hitting and damaging an adjacent wall, while providing an interchangeable decorative member, such that the door stop assembly may be used to enhance the décor and aesthetics of a room. The present invention contemplates elimination of drawbacks associated with an unadorned doorstop and provision of a door stop assembly with a detachable decorative member.

SUMMARY OF THE INVENTION

It is, therefore, an object of the present invention to provide a doorstop assembly having a decorative member.

It is another object of the invention to provide a doorstop assembly having a detachable decorative member.

These and other objects of the invention are achieved through a provision of a doorstop assembly comprising an elongated rectangular post and a decorative member configured for frictionally detachably engaging the post. The post is securable to a location behind the door. The decorative member carries a fitting member on the back surface thereof. The fitting member allows for snapping the decorative member into engagement with the post.

BRIEF DESCRIPTION OF DRAWINGS

Reference will now be made to the drawings, wherein like parts are designated by like numerals, and wherein.

DETAILED DESCRIPTION OF THE INVENTION

Figure 1:
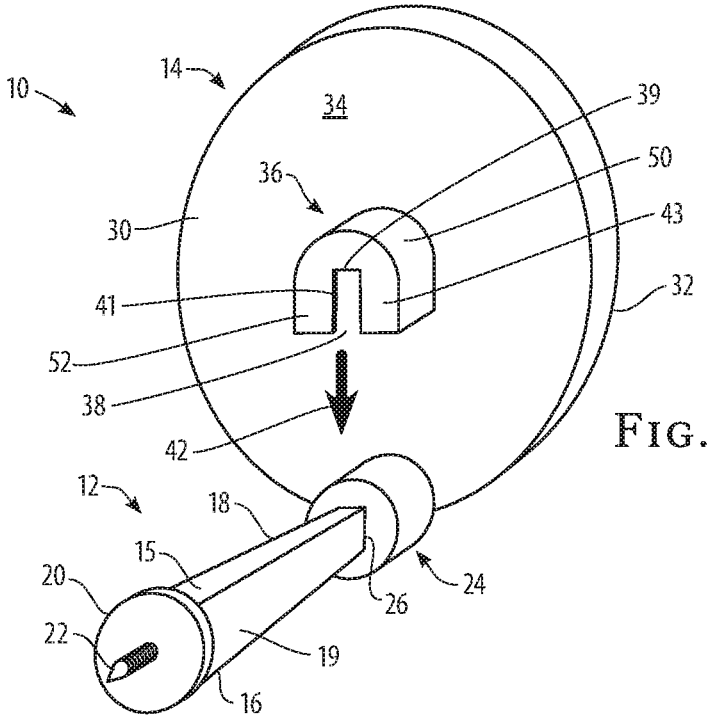
FIG. 1 is a perspective view of the doorstop assembly of the present invention, with a decorative member detached.
Figure 2:
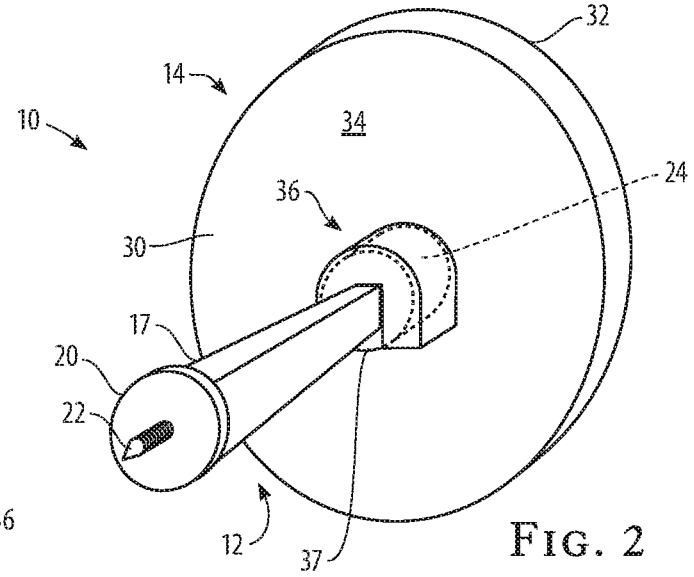
FIG. 2 is a perspective view of the doorstop assembly of the present invention, with the decorative member engaged with the doorstop post and the post tip.

Turning now to the drawings in more detail, numeral 10 designates the door stop assembly according the present invention. The assembly 10 comprises an elongated post 12 and a detachable decorative member 14. The post 12 has a proximate end 16 and a distant end 18. The post 12 has a generally rectangular or square cross section between the proximate end 16 and the distant end 18. In one aspect of the invention, the post 12 is a solid rigid body, although it is envisioned that a hollow body may be used as well.

The proximate end 16 of the post 12 can be formed wider than the distant end 18 such that the post 12 tapers toward the distant end 18. Of course, the post 12 can be formed as a parallelepiped and have uniform thickness from the proximate end 16 to the distant end 18. The post 12 can be manufactured from metal, metal alloy, plastic, wood or other suitable material.

The proximate end 16 carries an end plate 20, which can be circular in cross section. The end plate 20 can be formed from the same material as the post 12, if desired. The end plate 20 is fitted end-to-end against the proximate end 16 of the post 12. A securing screw 22 extends outwardly from the end plate 20. The securing screw 22 has exterior threads configured for threadably engaging a framework of a door, a wall, a baseboard, or so forth behind an interior door of a building. In one exemplary embodiment, the post is about 3 inches long, and the securing screw is about 0.5 inches long.

The distant end 18 of the post 12 carries a post tip 24. The post tip 24 may be constructed of flexible resilient material, such as natural or synthetic rubber, or a thermoplastic elastomer. The post tip 24 has a generally cylindrical configuration with a square opening 26 configured to receive the distant end 18 of the post 12 therein. The post tip 24 is affixed to the distant end 18 in a non-rotatable manner. In one exemplary embodiment, the post tip 24 is about 0.5 inch in diameter and about 0.5 inches long.

The decorative member 14 comprises a disk-shaped body 30 having a front surface 32 and a back surface 34. A fitting member 36 is secured to the back surface 34. The fitting member 36 comprises a rigid body having an arcuate configuration. The body of the fitting member 36 is defined by a continuous arcuate cover 50 extending transversely to a normal plane of the back surface 34 of the decorative member 14 and by a closing wall 52, which extends parallel to the back surface 34 of the decorative member 14, while following the arcuate configuration of the cover 50. The fitting member 36 has an open bottom 37 to allow positioning of the fitting member on the post 12. The radius of curvature of the fitting member 36 is at least slightly greater than the radius of the post tip 24.

A rectangular cutout 38 is formed in the closing wall 52 formed therein. The cutout 38 is configured to accommodate the post tip 24 and at least a portion of the distant end 18 of the post 12. The cutout 38 has a pre-determined length, which is at least slightly greater than the length of the post tip 24.

The cutout 38 is formed with a front rectangular entry having upper surface 39 and a pair of parallel opposing side surfaces 41, 43 intersecting the upper surface 39. For ease of explanation, the post 12 is shown to have a top surface 15 and a pair of parallel sidewalls 17 and 19. In order to position the decorative member on the post 12, the user moves the decorative member 14 in the direction of arrow 42 and forces the fitting member 36 over the post tip 24. In this position, the upper surface 39 of the front entry of the cutout 38 rests on the flat top surface 15 of the post 12, while the side surfaces 41 and 43 of the front entry of the cutout 38 contact the sidewalls 17, 19 of the post 12, respectively.

Figure 3:
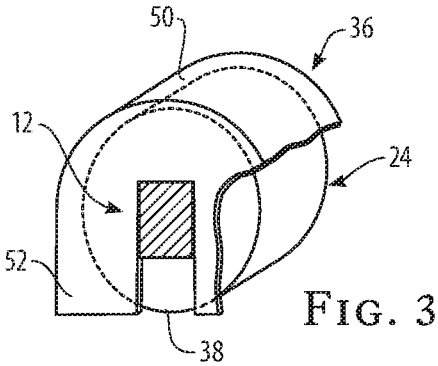
FIG. 3 is a detail, partially cutaway view showing position of the post tip housed in the fitting member.

The post tip 24 and at least a portion of the distant end 18 of the post 12 are tightly fit within the cutout 38. As can be seen in FIG. 3, the cutout 38 closely follows configuration of the post end 18 such that the decorative member 14 snaps onto the post 12, while the post tip 24 is housed within the fitting member 36. The closing wall 52 defining the cutout 38 frictionally engages the distant end 18 of the post 12 when the fitting member 36 is engaged with the post 12. The flat surfaces of the front entry of the cutout 38 and flat surfaces of the post 12 prevent rotation of the decorative member 14 about its axis. As a result, any decorative feature imprinted on the front surface 32 will not be distorted.

In one aspect of the invention, the fitting member 36 is centered on the round back surface 34 of the decorative member 14. The fitting member can be constructed as a rigid unitary body from natural or synthetic rubber, or a thermoplastic elastomer. The front surface 32 of the decorative member 14 is smooth and protrusion free. The decorative indicia imprinted on the front surface 32 can be made to match the room decor.

The decorative member 14 can be interchangeable with other decorative members having different design, color, or motif imprinted on the front surface 32. In changing the decorative member 14, the user will move the decorative member 14 in the direction opposite to the direction of arrow 42 and disengage the decorative member 14 from the doorstop post 12. The doorstop post 12 will remain attached to the wall or a baseboard, while only the decorative member 14 is changed.

Preferably, the door stop assembly of the present invention would be relatively inexpensive to manufacture and relatively simple to install, with the interchangeable decorative member being relatively simple to change. The decorative member can be constructed as a body having any desired configuration, including, without limitation, a geometric shape, a shape resembling a human, an animal, a plant, and so forth. The fitting member can be secured on the back surface of any such body.

Figure 4:
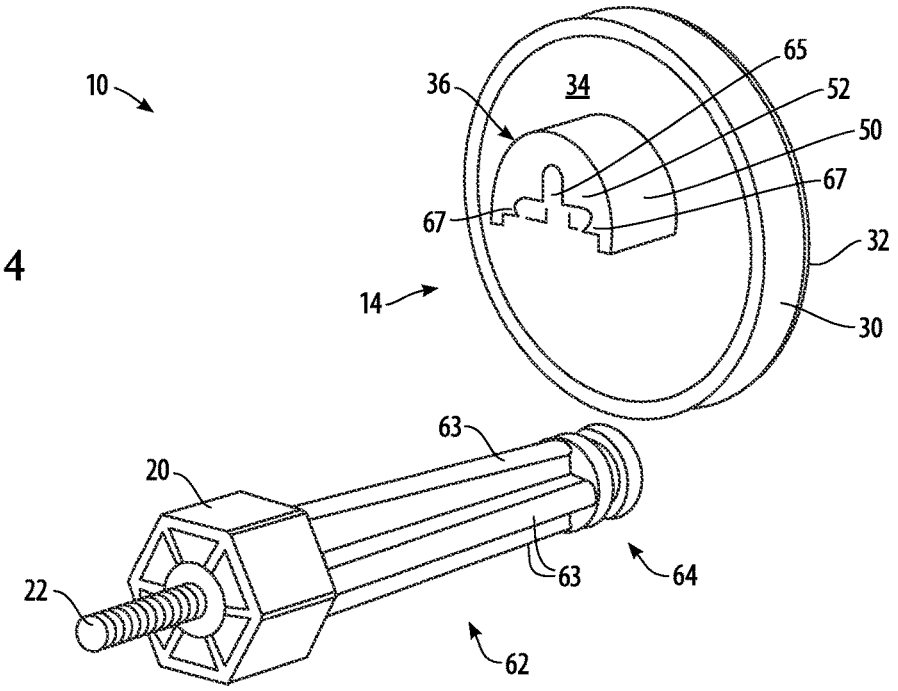
FIG. 4 is a perspective view of a second embodiment of the doorstop assembly of the present invention, with a decorative member detached.
Figure 5:
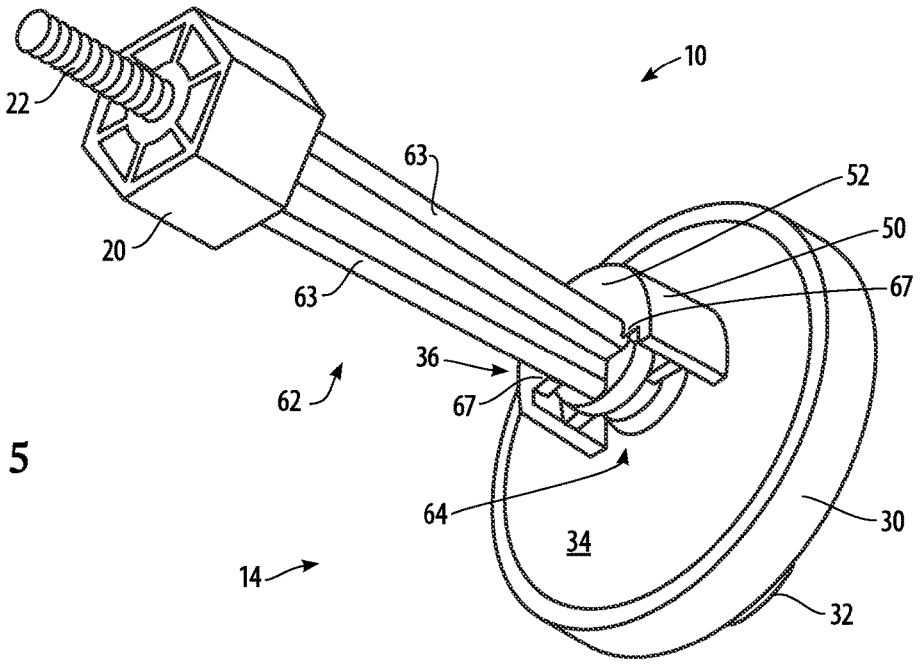
FIG. 5 is a perspective view of a second embodiment of the doorstop assembly of the doorstop assembly of the present invention, with the decorative member engaged with the doorstop post and the post tip.
Figure 6:
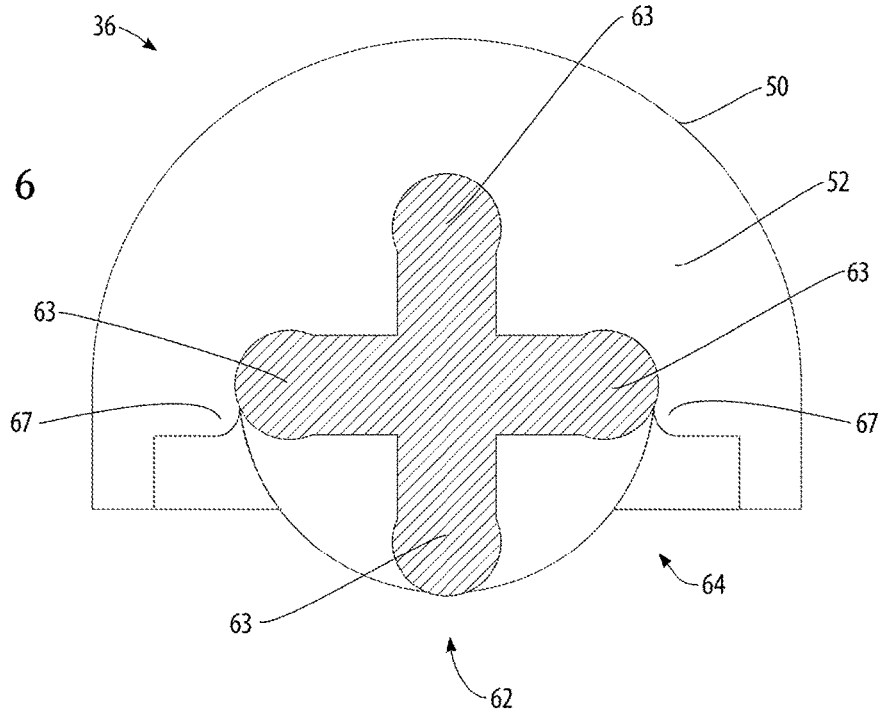
FIG. 6 is a detail, partially cutaway view showing position of the post tip housed in the fitting member of a second embodiment of the doorstop assembly.

Referring now to FIG. 4 & FIG. 5, in a second preferred embodiment of the door stop assembly of the invention, a cruciform-section elongated member 62 is provided, having four arms 63 that are bulbous at the ends distal from the central axis. At the end of the cruciform-section elongated member 62 is a dual-disk post tip 64 having two larger disks connected by a smaller cylindrical spacer section. In the closing wall 52 of the fitting member 36 is provided a partial-cruciform cutout 65 of a size and shape to accommodate the cruciform-section elongated member 62 at its attachment to the dual-disk post tip 64. The partial-cruciform cutout 65 accommodates slightly more than the upper half of the cruciform-section elongated member 62, thereby providing enclosing bumps 67 that grip and securely hold the cruciform-section elongated member 62 after the decorative member 14 is pushed down on the cruciform-section elongated member 62 with a slight force, sufficient to snap or click the enclosing bumps 67 around the bulbous ends of the two nominally horizontal arms 63. The fit of the enclosing bumps 67 is illustrated in FIG. 6. This placement of the enclosing bumps 67 around the bulbous ends of the horizontal arms 63, plus the fit of the upper arm 63 in the partial-cruciform cutout 65, lock the detachable decorative member 14 in position, ensuring that the chosen design on the front surface 32 is held in the correct orientation.

Figure 7:
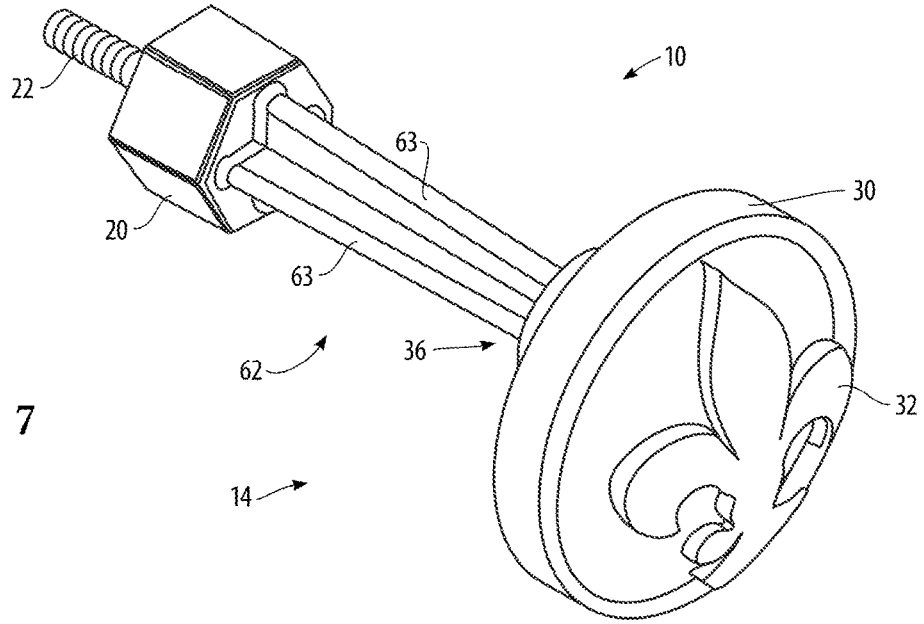
FIG. 7 is a perspective view of a second embodiment of the doorstop assembly of the doorstop assembly of the present invention.

Referring additionally to FIG. 7, the front surface 32 of the disk-shaped body 30 of the detachable decorative member 14 can be provided in various flat or three-dimensional designs, which can be removed, replaced, and interchanged with other detachable decorative members 14.

Many changes and modifications can be made in the present invention without departing from the spirit thereof. I therefore pray that rights to the present invention be limited only by the scope of the appended claims.

What is claimed is:

1. A doorstop assembly, comprising:

(i) an elongated post having a proximate end and a distant end;

(ii) a means carried by the proximate end for securing the post behind an interior door of a building;

(iii) a decorative member detachably engageable with the distant end of the post, said decorative member having a front surface configured for receiving decorative indicia thereon; and (iv) a post tip affixed to the distant end of the post;

wherein said post has a cruciform cross section formed with two vertical arms and two horizontal arms, each of the horizontal arms having bulbous ends;

wherein said post tip has a circular cross-section;

wherein said decorative member has a back surface and a front surface, and wherein a fitting member is secured on said back surface;

wherein said fitting member comprising an arcuate body having an arcuate cover, an open bottom, and a closing wall secured to the cover while following curvature of the cover;

wherein a partial cruciform cutout is formed in the closing wall, said cutout being configured to follow configuration of the distant end of the post and to prevent rotation of the decorative member in relation to the post; and wherein the cutout has a pair of enclosing bumps that grip and securely hold the bulbous ends of the horizontal arms.

2. The assembly of claim 1, said fitting member being configured to detachably engage said post tip and at least a portion of the distant end of the post.

3. The assembly of claim 2, wherein said fitting member is configured to snap over at least a portion of the distant end of the post, while frictionally engaging the distant end of the post.

4. The assembly of claim 1, wherein the means for engaging comprises an externally threaded securing screw attached to the proximate end of the post.

5. The assembly of claim 4, wherein an end plate is fitted end-to-end against the proximate end of the post.

6. The assembly of claim 5, wherein the securing screw extends outwardly from the end plate.

7. A doorstop assembly, comprising:

(i) an elongated cruciform cross-section post having a proximate end and a distant end, the post formed with two vertical arms and two horizontal arms, each of the horizontal arms having bulbous ends;

(ii) a means carried by the proximate end for securing the post behind an interior door of a building;

(iii) a decorative member detachably engageable with the distant end of the post, said decorative member having a front surface configured for receiving decorative indicia thereon and a back surface; and (iv) a fitting member secured on the back surface of the decorative member, said fitting member being configured to frictionally detachably engage at least a portion of the distant end of the post;

said fitting member comprising an arcuate body having an arcuate cover, an open bottom, and a closing wall secured to the cover and following curvature of the cover;

wherein a partial cruciform cutout is formed in the closing wall, said cutout being configured to follow configuration of the distant end of the post and to prevent rotation of the decorative member in relation to the post;

wherein the cutout has a pair of enclosing bumps that grip and securely hold the bulbous ends of the horizontal arms.

8. The assembly of claim 7, wherein the means for engaging comprises an externally threaded securing screw attached to the proximate end of the post.

9. The assembly of claim 8, wherein an end plate is fitted end-to-end against the proximate end of the post.

10. The assembly of claim 9, wherein the securing screw extends outwardly from the end plate.

11. The assembly of claim 7, comprising a post tip affixed to the distant end of the post.

* * * * *